United States Patent [19]

Zaizen et al.

[11] Patent Number: 4,470,802

[45] Date of Patent: Sep. 11, 1984

[54] HIGHLY BUILDUP-RESISTANT HEARTH ROLL FOR CONVEYING A STEEL STRIP THROUGH A CONTINUOUS ANNEALING FURNACE AND A METHOD THEREFOR

[75] Inventors: Takashi Zaizen; Yasuo Otoguro; Mikio Yamanaka, all of Sagamihara, Japan

[73] Assignee: Nippon Steel Corporation, Tokyo, Japan

[21] Appl. No.: 479,981

[22] Filed: Mar. 29, 1983

[30] Foreign Application Priority Data

Mar. 31, 1982 [JP] Japan ..... 57-51057
Feb. 18, 1983 [JP] Japan ..... 57-25888

[51] Int. Cl.[3] ..... F24D 23/02; F27D 3/00

[52] U.S. Cl. ..... 432/2; 266/102; 432/59; 432/246

[58] Field of Search ..... 432/2, 59, 246; 266/102

[56] References Cited

U.S. PATENT DOCUMENTS 2,695,247 11/1954 Ornitz et al. ..... 432/246
2,772,872 12/1956 Ornitz ..... 432/246
2,984,473 5/1961 Ornitz et al. ..... 432/246
4,391,879 7/1983 Fabian et al. ..... 428/551

*Primary Examiner*—John J. Camby
*Attorney, Agent, or Firm*—Wenderoth, Lind & Ponack

[57] ABSTRACT

In a continuous annealing furnace, a steel strip is conveyed by conventional hearth rolls made of heat-resistant cast steel, such as HK 40. However, since the formation of buildup is frequent, conventional hearth rolls are inappropriate for long-term operation of a continuous annealing furnace. In the hearth roll of the present invention, which consists of a solid or hollow roll body and a surface layer, the surface layer containing more than 15% by weight of Nb and the balance being inorganic material, the formation of buildup is not frequest, thereby making long-term operation of a continuous annealing furnace possible.

6 Claims, 3 Drawing Figures

HIGHLY BUILDUP-RESISTANT HEARTH ROLL FOR CONVEYING A STEEL STRIP THROUGH A CONTINUOUS ANNEALING FURNACE AND A METHOD THEREFOR

The present invention relates to a hearth roll for conveying a steel strip through a continuous annealing furnace and to a method therefor.

The continuous annealing of a steel strip is advantageous over box annealing because of its high productivity and its homogeneity in annealing. Therefore, coutinuous annealing method has been prevailing recently.

A steel strip is conveyed through a continuous annealing furnace by means of hearth rolls. During the conveying of a steel strip, scale and a part of the steel surface adhere to the hearth rolls, thereby forming a deposit. Such a deposit is referred to as buildup or pick-up and is hereinafter referred to as buildup.

When the buildup grows up to a certain size, it causes defects on the surface of a steel strip, and, occasionally, the buildup peels off of the surface of the hearth rolls and adheres to the surface of the steel strip, thereby deteriorating the surface quality of the steel strip. The buildup is one of the important factors which may impair the quality of a steel strip. So once the buildup appears on the roll surface the operation should be halted to remove the buildup by grinding the entire surface of the hearth rolls, which decreases the operation efficienty of the furnace a great deal. In some cases, a continuous annealing furnace is operated under a condition in which buildup hardly occur. In such a case, however, the productivity of the continuous annealing furnace is decreased, because the furnace temperature and its atmosphere should be strictly restricted within a certain range.

Conventionally, hearth rolls made of HK 40, i.e., Fe-25% Cr-20% Ni, are installed in a high-temperature zone (600° C. or more) of a continuous annealing furnace and hearth rolls made of ASTM 387-22 (Fe-2¼% Cr-1% Mo) are used in a relatively low-temperature zone (less than 600° C.) of a continuous annealing furnace. Buildup frequently grows on the surface of these hearth rolls. Even if these rolls are made of higher grade material containing larger amounts of Cr and Ni than those of HK 40 and ASTM 387-22, the formation of buildup cannot be prevented. In addition, the surface coating of Cr or Ni is applied to the roll, it does not effectively prevent the formation of buildup.

Japanese Examined patent publication No. 55-51007/1980 discloses a concentric dual hearth roll in which the metallic core body is concentrically inserted into a sleeve mainly composed of silica. Since the thermal expansion coefficients of the sleeve and the metallic core body are considerably different from one another and since silica has a low bending strength at a high temperature, this concentric dual hearth roll may cause various problems for conveying a steel strip in a continuous annealing furnace.

It is an object of the present invention to provide a highly buildup resistant hearth roll for conveying a steel strip through a continuous annealing furnace. This hearth roll is hereinafter simply referred to as hearth roll.

It is another object of the present invention to provide a method for conveying a steel strip through a continuous annealing furnace, by which method the operation efficiency and productivity of a continuous annealing furnace are enhanced.

In accordance with the objects of the present invention, there is provided a hearth roll consisting of a solid or hollow roll body and a surface layer, the surface layer containing more than 15%, preferably at least 20%, by weight of Nb, the balance being inorganic material including a thermally stable carbide.

In accordance with the objects of the present invention, there is provided a method for conveying a steel strip through a continuous annealing furnace comprising a heating zone, a soaking zone, a cooling zone and over-aging zone, in which cooling zone a gaseous or liquid cooling medium is blown onto the steel strip, the steel strip being conveyed successively through the heating zone, the soaking zone, the cooling zone and over-aging zone while being continually in contact with rotatable hearth rolls, characterized in that the steel strip is in contact with the inorganic material of the hearth rolls, the inorganic material containing more than 15% by weight of Nb, at least in a portion of the continuous annealing furnace where the steel strip has a temperature of 350° C. or more.

In accordance with a preferred embodiment of the present invention, steel strips can be conveyed for at least 25 days, preferably 30 days, and more preferably 40 days without any buildup being formed.

A hearth roll containing more than 15% by weight of Nb in the surface layer thereof makes it possible to prevent the formation of buildup. Since metallic Fe or scale does not stick to Nb or a Nb alloy at a high temperature and since Nb or a Nb alloy has a higher toughness at a high temperature than do ceramic materials, a hearth roll may be entirely made of a Nb or a Nb alloy. However, this is expensive. Therefore, the hearth roll according to the present invention comprises Nb or a Nb alloy surface layer. The thickness of the surface layer should be at least 1 μm.

It is preferred that the content of Nb be 20% by weight or more if the annealing conditions are severe, i.e., if buildup is promoted.

The inorganic material of the surface layer may be at least one element selected from the group consisting of Cr, Zr, V, W, Fe, Ti, Mo, Ta, Ni, Co, Mn, Al, Si, La, Ce, Y, Mg, Sn, Zn, Cu, Sb, Bi, Ag, Pt, and Rh. The inorganic material may be an oxide, nitride, carbide, or silicic compound of one or more of these metals.

The surface layer preferably consists of 50% by weight or more of Nb and from 0.5% to 50% by weight of at least one element selected from the group consisting of Ti, V, Cr, Co, Zr, Mo, Ta, and W.

The surface layer is usually formed by laminating a Nb or a Nb alloy sheet around the roll body. The surface layer can also be formed by means of plasma spraying, overlaying, dual-layer centrifugal casting, sintering, or any other means for producing a composite material. When metal such as Nb is plasma sprayed, it is partly oxidized, and metal oxide is incorporated into the surface layer. However, the metal oxide does not appreciably impair the buildup resistance of the surface layer.

The present invention is hereinafter described in detail with reference to the drawings, wherein.

Figure 1:
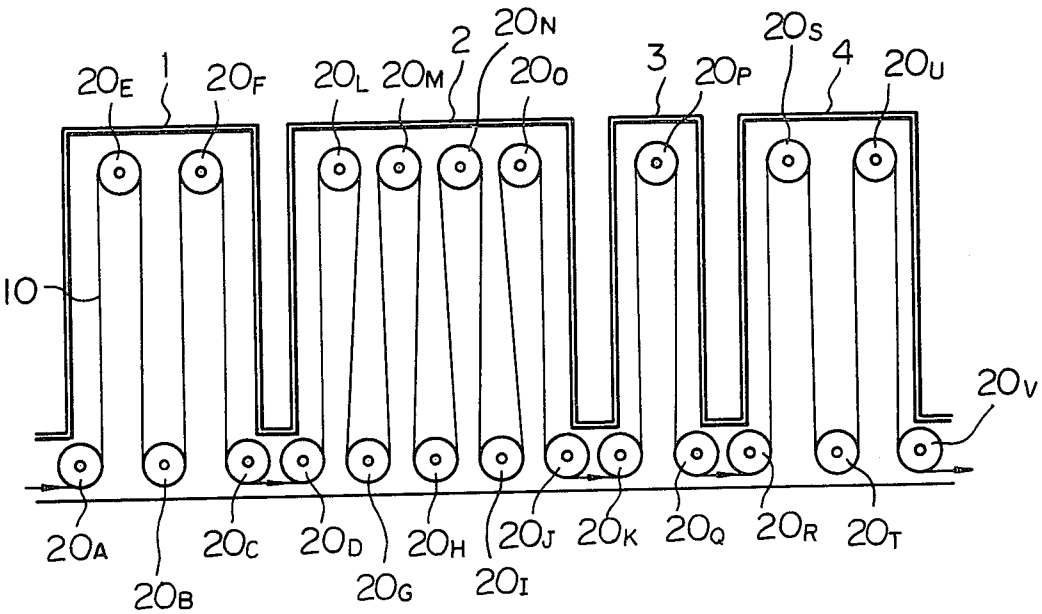
FIG. 1 is a schematic view of a conventional continuous annealing furnace.

In FIG. 1, the conventional continuous annealing furnace consists of a preheating zone (not shown), a heating zone 1, a soaking zone 2, a first cooling zone 3, an over-aging zone 4, and a second cooling zone (not shown). If a continuous annealing furnace is used for annealing a galvanized steel strip, the furnace is not provided with the over-aging zone 4 and the second cooling zone. The continuous annealing furnace may be a vertical-type furnace, as shown in FIG. 1, or a horizontal-type furnace, in which a steel strip is conveyed in a horizontal direction. Reference numerals $20_A$ through 20V denote hearth rolls. Reference numerals $20_A$ through $20_F$ of the heating zone 1, $20_G$ through 20 denote those of the soaking zone 2, Reference numerals $20_P$ and $20_R$ denote the hearth rolls of the cooling zone 3, and $20_S$ through $20_V$ denote those of the over-aging zone 4.

If the heating zone 1 is provided with radiant tubes therein, the steel strip 10 is usually heated to a temperature of from approximately 600° C. to approximately 900° C. in a reducing atmosphere, and, therefore, the formation of buildup in the heating furnace is relatively slight.

If the heating zone is an NOF (non oxidization furnace) type of heating furnace provided with burners, the steel strip 10 is directly heated by a flame generated by controlling the air-fuel ratio so that the amount of air is slightly less than that required for perfect combustion. The furnace temperature is approximately 1,000° C. or more. The hearth rolls $20_A$ through $20_F$ are provided with a shield (not shown) so as to maintain their temperature at approximately 800° C. or less. Since the surface of the steel strip 10 is slightly oxidized, the formation of buildup is heavy in an NOF type of heating zone.

The soaking zone 2 has a reducing atmosphere and its temperature is from 600° C. to 900° C.

In the cooling zone 3, the steel strip 10 is cooled with water, a water-gas mixture, or an inert gas.

Buildup formation is caused not only by oxide scale of the strips but also by the metallic iron which is brought into contact with the hearth rolls $20_A$ through $20_V$.

The preferred surface layers of the hearth rolls are described with reference to the types of heating and cooling zone in a continuous annealing furnace.

Heating zone

Radiant-tube type $20_A \sim 20_D$-Nb-70Ti-2Zr $20_E \sim 20_F$-Nb-20Cr-50Ti

NOF type $20_A \sim 20_D$-Nb-1Zr, Nb 30Ti-2Zr $20_E \sim 20_F$-Nb-50Ti-2Zr

Soaking Zone $20_G \sim 20_K$-Nb-70Ti-2Zn $20_L \sim 20_O$-Nb-20Cr-50Ti

Cooling Zone and Over-Aging Furnace

Inert gas-cooling type $20_P \sim 20_V$-19Nb-10Mo-2Al-Ni

Figure 2:
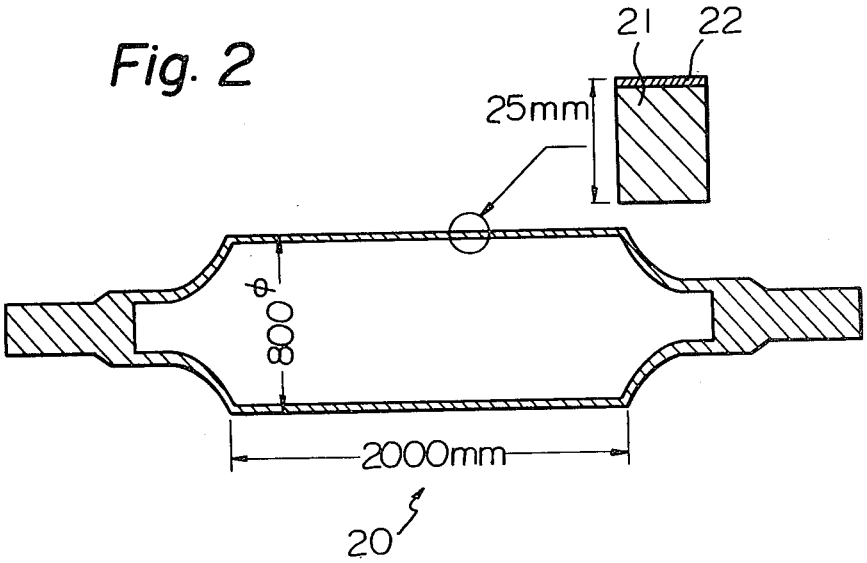
FIG. 2 is a cross-sectional view of a hearth roll according to an embodiment of the present invention.

According to an embodiment of the present invention, the hearth roll 20 shown in FIG. 2 is a hollow type of hearth roll consisting of a hallow roll body 21 and a surface layer 22. The hollow roll body 21 consists of, for example, heat-resistant steel or cast steel such as HK 40.

A Nb alloy is usually prepared by mixing Nb particles and inorganic material particles with each other and then melting the power mixture in an electron beam furnace or an argon arc furnace. If the inorganic material has a boiling point lower than the melting point of Nb, as do Al, Si, Mg, Sn, Zn, Sb, and Bi, or if the inorganic material has a high vapor pressure at an elevated temperature, as does Mn, the powder mixture of Nb and the inorganic material should be sintered. When the sintered body is hot- or cold -workable, it is subjected to, for example, hot or cold rolling. These Nb alloys should be subjected to a homogenizing heat treatment after being cast or sintered and hot- or cold-rolled so as to obtain a Nb alloy sheet.

The present invention is hereinafter described with reference to the Examples.

EXAMPLE 1

Figure 3:
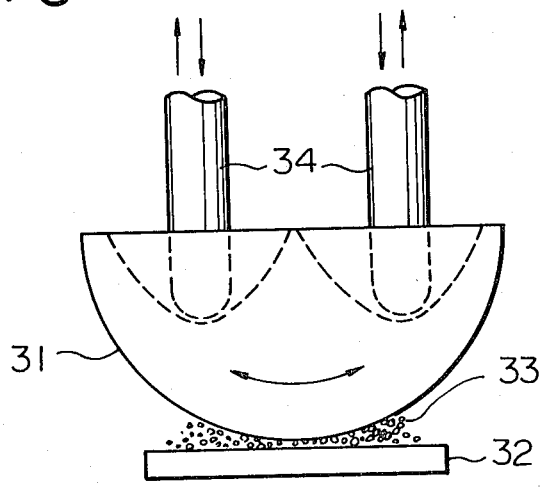
FIG. 3 illustrates a buildup resistance test.

Various materials were subjected to a test so as to evaluate their buildup-resistance. The device shown in FIG. 3 was used in the test. A constant load of 6 kg/mm$^2$ was imparted downward to a semicircular roll 31 via rods 34. The semicircular roll 3 was made of HK 40. A sample 32 to be tested was placed beneath the semicircular roll 31. $Fe_3O_4$ powder 33 was dispersed on the sample 32 as a material which forms the buildup. The semicircular roll 31 was swung back and forth (parallel to the sheet plane of FIG. 3) by the rods 34, thereby causing the $Fe_3O_4$ powder 33 to be in frictional contact with the sample 32. The test was carried out in a gas mixture consisting of 5% $H_2$ and 95% $N_2$ at a temperature of 850° C. for 8 hours. The results of the qualitative evaluation were given in the right column of the Table. This evaluation of buildup resistance was made based on the following standards.

(1) Buildup resistance of 3: when no buildup formed on the the sample 32

(2) Buildup resistance of 2: when buildup formed on the sample 32 but could be removed by rubbing it vigorously with a gauze (3) Buildup resistnace of 1: when buildup formed on the sample 32 and could be removed only by peeling it off with forceps (4) Buildup resistance of 0: when buildup formed on the sample 32 and could not be removed even with forceps In the Table, "Plasma Spraying" indicates that the metal particles and ceramic particles were mixed at a weight ratio of 20:1 and were plasma sprayed on a substrate made of HK 40.

| Sample Nos. | Kind of Material or Producing Method | Composition | Buildup Resistance |
|---|---|---|---|
| 1 Comparative Example | Heat Resisting Steel | HK4D(25Cr—20Ni—Bal Fe) | 0 |
| 2 Comparative Example | Heat Resisting Steel | HH(24Cr—12Ni—Bal Fe) | 0 |
| 3 Comparative | Heat | ASTM387 22(2~¼Cr—1Mo) | 0 |

-continued

| Sample Nos. | Kind of Material or Producing Method | Composition | Buildup Resistance |
|---|---|---|---|
| Example | Resisting Steel | | |
| 4 Comparative Example | Pure Metal | Ni | 0 |
| 5 Comparative Example | " | Cu* | 1 |
| 6 Comparative Example | " | Cr | 1 |
| 7 Invention | " | Nb | 3 |
| 8 " | Alloy | Nb—1Zr | 3 |
| 9 " | " | Nb—20Zr | 3 |
| 10 " | " | Nb—45Zr | 3 |
| 11 " | " | Nb—12W | 3 |
| 12 " | " | Nb—10Ti | 3 |
| 13 " | " | Nb—35Ti | 3 |
| 14 " | " | Nb—20Cr—12Co | 3 |
| 15 " | " | Nb—13V | 3 |
| 16 " | " | Nb—10Fe | 3 |
| 17 " | " | Nb—10Mo | 3 |
| 18 " | " | Nb—40Ta | 3 |
| 19 " | " | Nb—20Cr—20Ni | 3 |
| 20 " | " | Nb—5Mn—10Al | 3 |
| 21 " | " | Nb—5Mn—10Si | 3 |
| 22 " | " | Nb—1Ce—0.2La | 3 |
| 23 " | " | Nb—3Y | 3 |
| 24 " | " | Nb—1Mg | 3 |
| 25 " | " | Nb—10Sn | 3 |
| 26 " | " | Nb—2Zn | 3 |
| 27 " | " | Nb—10Cu | 3 |
| 28 " | " | Nb—3Sb | 3 |
| 29 " | " | Nb—3Bi | 3 |
| 30 " | " | Nb—5Ag | 3 |
| 31 " | " | Nb—10Pt—5Rh | 3 |
| 32 " | " | Nb—30Ti—2Zr | 3 |
| 33 " | " | Nb—40Ti—2Zr | 3 |
| 34 " | " | Nb—50Ti—2Zr | 3 |
| 35 " | " | Nb—60Ti—2Zr | 3 |
| 36 " | " | Nb—70Ti—2Zr | 3 |
| 37 " | " | Nb—20Cr—50Ti | 3 |
| 38 " | " | Nb—20Cr—60Ti | 3 |
| 39 Comparative Example | " | Nb—20Cr—70Ti | 1 |
| 40 Invention | " | Nb—80Ti—2Zr | 2 |
| 41 Comparative Example | " | Nb—90Ti—2Zr | 1 |
| 42 Invention | " | Ni—15Nb | 2 |
| 43 Comparative Example | " | Fe—10Nb | 1 |
| 44 Invention | " | Fe—15Nb | 2 |
| 45 " | Plasma Spraying | Nb—1Zr—($Al_2O_3$) | 3 |
| 46 " | Plasma Spraying | Nb—1Zr—($ZrO_2$) | 3 |
| 47 " | Plasma Spraying | Nb—1Zr—($ZrSiO_4$) | 3 |
| 48 " | Plasma Spraying | Nb—1Zr—(SiN) | 3 |
| 49 " | Plasma Spraying | Nb—1Zr—(SiC) | 3 |
| 50 Comparative Example | Alloy | 14Nb—Fe | 1 |
| 51 Invention | Overlaying | 21Nb—Fe | 2 |
| 52 " | " | 15.5Nb—Fe | 2 |
| 53 " | Plasma Spraying | 16.8Nb—Ni | 2 |
| 54 " | Plasma Spraying | 18Nb—20Cr—Ni | 3 |
| 55 " | Plasma Spraying | 19Nb—10Mo—2Al—Ni | 3 |
| 56 " | Plasma Spraying | 19.5Nb—1Zr—10Co—($Al_2O_3$) | 3 |
| 57 " | Plasma Spraying | 19Nb—1Zr—10Co—($ZrO_2$) | 3 |
| 58 " | Overlaying | 19.8Nb—20Cr—Ni | 3 |
| 59 " | " | 16Nb—15Cr—5Mo—10Fe—Ni | 3 |
| 60 " | " | 16Nb—Fe | 2 |
| 61 " | " | 16Nb—2Zr—Ti | 3 |
| 62 " | " | 25Nb—35Ti—40Fe | 3 |

-continued

| Sample Nos. | Kind of Material or Producing Method | Composition | Buildup Resistance |
|---|---|---|---|
| 63 " | " | 30Nb—5Zr—65Fe | 3 |
| 64 " | " | 30Nb—5Zr—20Ti—45Fe | 3 |

*The test for sample No. 5 was carried out at 600° C.

EXAMPLE 2

Three hearth rolls having a diameter of 160 mm and a length of 1,600 mm were prepared by providing on a HK 40 hollow roll body, a surface layer according to the present invention. In the first test, the surface layer was made of a Nb (100% Nb) sheet which was laminated to the hollow roll body a seam welding. The three rolls were installed in the soaking furnace of a horizontal-type continuous annealing furnace for annealing a steel strip for Zn galvanizing. The temperature in the soaking furnace was from 700° C. to 850° C. and the gas atmosphere in the soaking furnace consisted of a decomposition gas of ammonia (25% $N_2$ and 75% $H_2$).

In the second and third tests, the surface layer was made of a Nb-1% Zr alloy and of a Nb-40% Ta alloy, respectively.

In these three tests, no buildup was observed on the hearth rolls during a 40-day operation period.

When conventional hearth rolls made of HK 40 were installed in the soaking furnace mentioned above, operation of the continuous annealing furnance had to be stopped three times so as to condition the hearth roll surfaces.

EXAMPLE 3

The procedure of Example 2 was repeated except that the surface layer consisted of Fe-15.5% Nb in the first test and of Ni 18% Nb-20% Cr in the second test. In the third test surface layer was formed by overlaying Fe-15.5% Nb and Ni-8% Nb-20% Cr onto the HK 40 hollow roll bodies. All these rolls were installed in the soaking furnace of the continuous annealing furnace for galvanized steel where the temperature. The same results as in Example 2 were obtained.

EXAMPLE 4

The procedure of Example 2 was repeated except that all of the hearth rolls installed in the soaking furnace had a surface layer of 100% Nb, Nb-18% Zr alloy or Nb-40% Ta alloy. No buildup was formed on the hearth rolls during a 25-day operation period.

We claim:

1. A hearth roll for conveying a steel strip through a continuous annealing furnace, said-hearth roll consisting of a solid or hollow roll body and a surface layer, said surface layer containing more than 15% by weight of Nb, the balance being inorganic material.

2. A hearth roll according to claim 1, wherein said surface layer contains at least 20% of Nb.

3. A hearth roll according to claim 1, wherein said inorganic material is at least one element selected from the group consisting of Cr, Zr, V, W, Fe, Ti, Mo, Ta, Ni, Co, Mn, Al, Si, La, Ce, Y, Mg, Sn, Zn, Cu, Sb, Bi, Ag, Pt, and Rh.

4. A hearth roll according to claim 1, wherein said surface layer consists of 50% by weight or more of Nb and from 0.5% to 50% by weight of at least one element selected from the group consisting of Ti, V, Cr, Co, Zr, Mo, Ta and W.

5. A method for conveying a steel strip through a continuous annealing furnace comprising a heating zone, a soaking zone, a cooling zone and over-aging furnace, in which cooling zone a gaseous or liquid cooling medium is blown onto the steel strip, said steel strip being conveyed successively through the heating zone, the soaking zone, the cooling zone and over-aging zone, while being continuously in contact with rotatable hearth rolls, characterized in that said steel strip is in contact with the inorganic material of the hearth rolls, said inorganic material containing more than 15% by weight of Nb, at least in a portion of the continuous annealing furnace where said steel strip has a temperature of 350° C. or more.

6. A method according to claim 5, wherein said steel strips are conveyed for at least 30 days without any buildup being formed.

* * * * *